United States Patent [19]

Westmoreland

[11] 4,010,878

[45] Mar. 8, 1977

[54] DISPLAY FORM FOR BABY BOOTIE

[76] Inventor: Twain Westmoreland, Rte. 2, Box 168, Hillsville, Va. 24343

[22] Filed: May 3, 1976

[21] Appl. No.: 682,446

[52] U.S. Cl. ..... 223/75; 12/128 R

[51] Int. Cl.[2] ..... D06C 5/00

[58] Field of Search ..... 223/75, 76, 66; 12/128 R, 114.2

[56] References Cited

UNITED STATES PATENTS

| | | | |
|---|---|---|---|
| 1,632,954 | 6/1927 | De Witt | 12/128 R |
| 2,262,621 | 11/1941 | Reinhardt | 12/128 R |
| 2,567,081 | 9/1951 | Reser | 12/114.2 |
| 2,610,340 | 9/1952 | Nettler et al. | 12/128 R |
| 2,644,969 | 7/1953 | Reser | 12/114.2 |
| 2,690,862 | 10/1954 | Carr | 223/75 |
| 2,722,350 | 11/1955 | Kleutgen | 223/75 |
| 3,077,621 | 2/1963 | McGinnity | 12/128 R |

*Primary Examiner*—G. V. Larkin

*Attorney, Agent, or Firm*—Bell, Seltzer, Park & Gibson

[57] ABSTRACT

The display form is inserted within the baby bottie to maintain the bootie in a condition simulating the appearance of the bottle on the foot of a baby. The display form is molded of sheet plastic material with a length and width corresponding to the length and width of the foot portion of a baby bootie. An upper wall is provided with integral side walls extending downwardly on all sides and with opposite end portions being arcuate. The height of the side walls generally corresponds to the height of the foot portion of the bootie and the singlepiece display form is substantially hidden when inserted into the bootie.

5 Claims, 5 Drawing Figures

DISPLAY FORM FOR BABY BOOTIE

This invention relates generally to a single-piece display form for being inserted within a baby bootie for enhancing the display of the bootie to prospective purchasers, and more particularly to such a display form which is integrally molded of relatively thin sheet plastic material in an elongate shape and with an upper wall and side walls extending downwardly therefrom. The length, width and height of the display form generally corresponds to the corresponding length, width and height of the foot portion of the bootie.

Baby booties are usually formed of knit material and usually need some type of support for maintaining them in an upright and substantially extended condition for display purposes. It is known to form a display form to support a baby bootie by inserting an elongate flat cardboard in the bottom of the foot of the bootie, then inserting wadded tissue paper in the toe portion of the bootie, and then inserting a cardboard tube in the leg opening of the bootie. This type of display form requires the use of three separate supporting members, which increases the cost of producing booties. Also, this type supporting arrangement does not display the bootie in its most attractive form as the tube in the leg opening is visible to the prospective purchaser.

With the foregoing in mind, it is an object of the present invention to provide a single-piece display form adapted to be economically produced and inserted within a baby bootie for enhancing the display of the bootie. The form is molded of relatively thin sheet plastic material shaped to generally correspond to the length, width and height of the foot portion of the bootie.

In accordance with the present invention, the display form includes an elongate upper wall having arcuate ends and with one arcuate end being of a slightly larger radius of curvature than the other end. The length and width of the upper wall generally corresponds to the length and width of the foot portion of the bootie and integrally formed side walls extend downwardly from the upper wall. The side walls are connected to the upper wall along a radius so as to provide rounded corners of connection of the side walls to the upper wall for aiding in inserting the display form within the baby bootie. The height of the side walls are a fraction of the width of the upper wall and the height generally corresponds to the height of the foot portion of a bootie. The wider end of the form is adapted to be placed in the toe portion of the baby bootie and the side walls extend downwardly from the upper wall at an outwardly inclined angle of about five degrees so that the display form maintains the foot portion of the bootie in a slightly extended position. The ankle portion of the bootie extends upwardly above the display form and in a substantially straight-up condition so that the display form is substantially hidden in use. The display form is only a few inches long with the width of the upper wall being slightly greater than one-third the length and the side walls being about one-half as high as the width of the upper wall. The lower portion of the display form is hollow so that when inserted in a bootie provided with a longitudinal seam extending along the bottom of the foot, the seam will extend up into the hollow portion of the display form and the bootie will be displayed in an upright position.

Other objects and advantages will appear as the description proceeds when taken in connection with the accompanying drawings, in which FIG. 1 is an isometric view of a baby bootie and showing the display form of the present invention in dotted lines and positioned therein;

Figure 1:
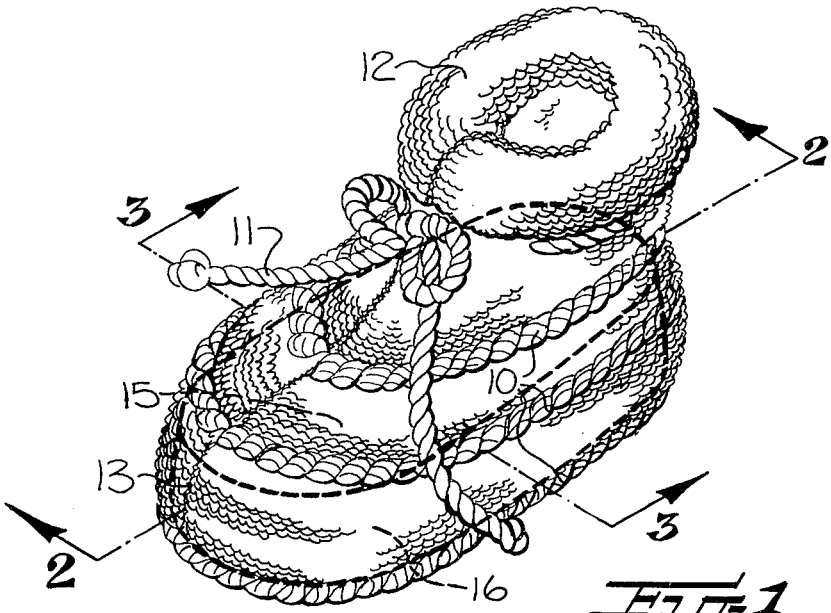

The bootie illustrated in the drawings is only one of many different types of booties with which the display form of the present invention may be used. The bootie is formed of knitted material with a soft exterior of terry loops and with spaced apart bands of large decorative yarns 10 incorporated in the knit fabric. A cord type tie or drawstring 11 may be threaded around the upper ankle portion 12 of the bootie. The bootie illustrated in the drawings is provided with a medial connecting seam 13 extending down the front of the foot portion and extending longitudinally along the sole of the foot portion.

Figure 2:
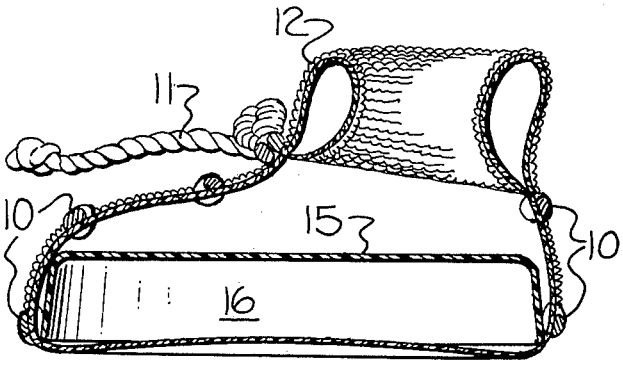
FIG. 2 is a longitudinal vertical section taken substantially along the line 2—2 in FIG. 1.
Figure 3:
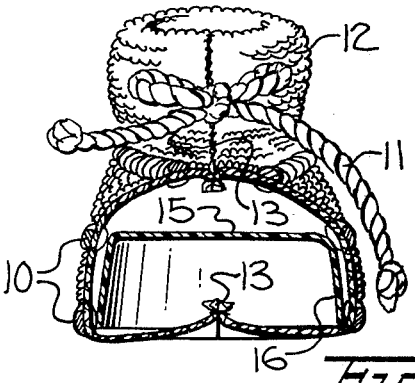
FIG. 3 is a transverse vertical sectional view taken substantially along the line 3—3 in FIG. 1.

As illustrated in FIGS. 1–3, the length, width and height of the display form generally corresponds to the length, width and height of the foot portion of the bootie. The display form is of the proper dimensions to maintain the foot portion of the bootie in a slightly stretched condition over the display form when it is inserted in the foot portion. The display form is generally elongated and is molded of a relatively thin sheet plastic material with a flat upper wall 15 including arcuate shaped opposite ends and relatively straight opposite sides interconnecting the arcuate ends.

Figure 5:
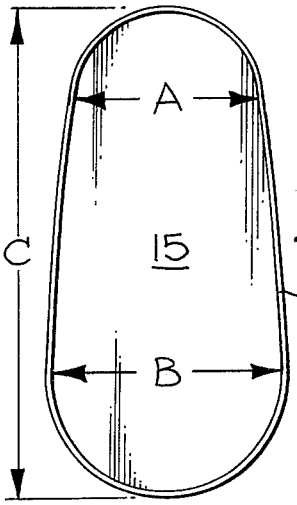
FIG. 5 is a plan view of the display form removed from the bootie.

The width of the upper wall 15 is a fraction of the length and the lower arcuate end in FIG. 5 is formed with a larger radius of curvature than the upper end. Although display forms of various dimensions may be used, it has been found that a display form having the dimensions set forth below is satisfactory for use in most baby booties. The upper wall 15 has an overall length of 3 3/16 inches, as indicated by dimension line C in FIG. 5, while the lower end has a width of 1 5/16 inches, indicated by the dimension line B and the upper end has a width of 1 3/16 inches, indicated by the dimension line A.

Figure 4:
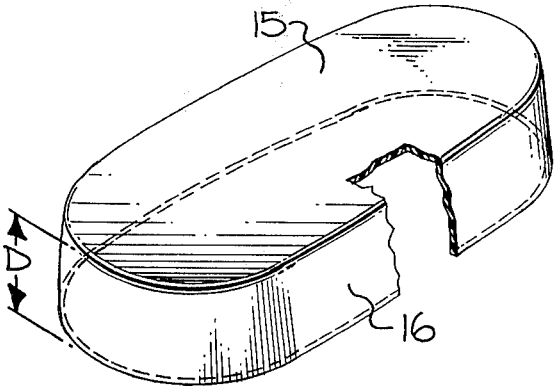
FIG. 4 is an isometric view of the display form removed from the bootie and with a portion broken away.

The display form is also provided with side walls 16 extending downwardly from the upper wall and on all sides thereof. The side walls 16 are integrally formed with the upper wall and are joined thereto along a radius so as to provide rounded corners of connection between the side walls 16 and the upper wall 15. As best illustrated in FIGS. 2 and 3, the side walls 16 extend downwardly from the upper wall 15 at an outwardly inclined angle of about 5°. The side walls 16 are about one-half as high as the width of the upper wall 15 and are about five-eighths of an inch high, as indicated by the dimension line D in FIG. 4.

While the display form of the present invention may be individually molded of sheet plastic material, it is to be understood that the display form may be formed of other types of material and that a plurality of display forms may be formed by vacuum molding a sheet of plastic material. The individual display forms may then be separated by cutting the plastic sheet around the lower edges of the side walls 16 of each of the display forms.

It is a simple matter to insert the single-piece display form into the leg opening at the upper end of the ankle portion 12 with the wider end portion being positioned in the toe end of the bootie. The other end of the display form is then lowered into the heel of the bootie, in the position shown in FIGS. 2 and 3, and the longitudinal seam 13 along the bottom of the sole of the bootie is positioned in the hollow lower portion of the display form. The display form can thus be placed in the bootie in a single operation and in a much more economical manner than the prior type of display insert which required inserting three separate pieces into the bootie. When positioned in the bootie, the display form is substantially hidden in the bootie and maintains the foot portion of the bootie in a slightly stretched condition thereon. The ankle portion 12 of the bootie extends upwardly above the display form so that the baby bootie is displayed in substantially the position it assumes when worn by a baby.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. The combination of a display form and a baby bootie including a foot and ankle portion, said display form including an integrally formed elongate member having an overall length of only a few inches and a width of a fraction of its length and wherein the length and width generally correspond to the length and width of the foot portion of the baby bootie, said member including an upper wall spaced above the bottom of the bootie and with side walls extending downwardly therefrom on all sides thereof and being connected to the upper wall along a radius so as to provide rounded corners of connection of the side walls to the upper wall for aiding in inserting the display form within the baby bootie, and wherein the height of the side walls is a fraction of the width of said upper wall and wherein the height of the side walls generally corresponds to the height of the foot portion of the bootie so that the ankle portion of the bootie extends upwardly above the display form and the display form is substantially hidden in use.

2. The invention according to claim 1 wherein said upper wall is wider adjacent one end thereof to correspond to the wider width toe portion of the baby bootie.

3. The invention according to claim 1 wherein said side walls extend downwardly from said upper wall at an outwardly inclined angle of about five degrees.

4. The invention according to claim 1 wherein said upper wall has arcuate shaped opposite ends and relatively straight opposite side portions interconnecting said arcuate ends and wherein one arcuate end is formed on a larger radius of curvature than the other end, and wherein said one arcuate end is adapted to be positioned within the toe portion of the bootie for simulating the appearance of the bootie as being worn by a baby.

5. The invention according to claim 1 wherein the width of said upper wall is slightly greater than one-third the length of said upper wall, and wherein said side walls are about one-half as high as the width of said upper wall.

* * * * *